US007452259B2

(12) United States Patent
Maleika

(10) Patent No.: US 7,452,259 B2
(45) Date of Patent: Nov. 18, 2008

(54) SPEED CONTROLLER FOR TOY VEHICLES

(75) Inventor: Hubertus Maleika, Zirndorf (DE)

(73) Assignee: Stadlbauer Spielund Freizeit GmbH, Nurnberg (DE)

( * ) Notice: Subject to any disclaimer, the term of this patent is extended or adjusted under 35 U.S.C. 154(b) by 728 days.

(21) Appl. No.: 10/477,930

(22) PCT Filed: Apr. 18, 2002

(86) PCT No.: PCT/DE02/01440

§ 371 (c)(1),
(2), (4) Date: Mar. 23, 2004

(87) PCT Pub. No.: WO02/094402

PCT Pub. Date: Nov. 28, 2002

(65) Prior Publication Data

US 2004/0180605 A1 Sep. 16, 2004

(30) Foreign Application Priority Data

May 18, 2001 (DE) ..... 101 24 456

(51) Int. Cl.
*A63H 30/00* (2006.01)

(52) U.S. Cl. ..... 446/455; 446/484; 104/60

(58) Field of Classification Search ..... 446/455; 463/62, 63; 104/289, 305, 60
See application file for complete search history.

(56) References Cited

U.S. PATENT DOCUMENTS

| | | | | |
|---|---|---|---|---|
| 4,247,108 | A | 1/1981 | Tilbor et al. | |
| 4,728,104 | A * | 3/1988 | Cheng | 104/289 |
| 5,484,321 | A | 1/1996 | Ishimoto | |
| 5,577,155 | A * | 11/1996 | Buchbinder | 388/839 |
| 6,445,150 | B1 * | 9/2002 | Tanner et al. | 318/280 |
| 2004/0107864 | A1 * | 6/2004 | Hayden | 104/288 |

* cited by examiner

*Primary Examiner*—Robert E Pezzuto
*Assistant Examiner*—Alex F. R. P. Rada, II
(74) *Attorney, Agent, or Firm*—Lowe Hauptman Ham & Berner LLP

(57) ABSTRACT

A speed controller for toy vehicles on a toy car racetrack has a manual controller for varying an electrical driving voltage from an electric power supply for the car racetrack. The manual controller is manually displaced over a preset operating path so the driving voltage derived by the electric power supply varies from zero to a first preset maximum value below the voltage that is derived by the electric power supply. An additional controller responds to manual operation to set the driving voltage applied to the car racetrack, to a second preset value above the maximum driving voltage that is derived by the controller for varying the electrical driving voltage.

21 Claims, 2 Drawing Sheets

SPEED CONTROLLER FOR TOY VEHICLES

FIELD OF INVENTION

The invention relates to a speed controller for toy vehicles on a toy car racetrack.

BACKGROUND ART

The goal, for example, of track-guided car racetracks is to manually guide a toy vehicle during a race as fast as possible along the track while controlling the driving speed and preventing the toy vehicle from undesirably leaving the racetrack; that is, jumping the track. Conventionally, an electric motor is provided as the drive of the toy vehicle, the drive shaft protruding at one end of the motor and ending in a transmission. In this case, a pinion is arranged at the transmission-side end of the drive shaft. The joint axle of the driven wheels, which carries a crown wheel, also extends through the transmission. In the transmission, the pinion and the crown wheel intermesh, a different number of teeth of the pinion and of the crown wheel causing a corresponding transmission ratio. The motor receives a driving or running voltage from corresponding conductor rails on the car racetrack. This driving or running voltage is varied by a player by means of a manual controller or a manually operable speed controller, so that the player moves the toy vehicle over the car racetrack. However, in this case, the player has to pay close attention to increasing the driving voltage not to such an extent mainly in front of curves and in curves that the toy vehicle jumps the track because of excessive speed. Frequently, it is not possible on 90% or more of the racetrack route to move the toy vehicle at a maximal running voltage, that is, at a maximal speed. A corresponding range of the dynamics of the manual controller is therefore lost. On the other hand, there are racetrack sections, such as loopings, on which a high speed is required for a short time and in a rapid manner, so that the toy vehicle does not fall out of the track.

SUMMARY OF THE INVENTION

It is an object of the present invention to improve a manually operable speed controller of the above-mentioned type such that toy vehicles can be moved better and more comfortably along a car racetrack. In particular, it should become possible for inexperienced operators to provide a rapid successful event when operating toy vehicles; that is, also inexperienced operators should rapidly be capable of successively driving several complete racetrack rounds while preventing the vehicle from jumping the track because of an excessive speed. On the whole, the subjective vehicle handling of toy vehicles is to be improved by way of a corresponding optimization of the manual or speed controller.

In accordance with one aspect of the present invention, a speed controller for toy vehicles on a toy car racetrack includes a manually operable controller for varying an electric driving voltage from an electric power supply for the car racetrack. The controller for varying the electric driving voltage is manually movable along a predetermined operating path and constructed such that it varies the driving voltage supplied by the electric power supply along the operating path from zero to a first predetermined maximal value below the voltage supplied by the electric power supply. An additional controller, when manually operated, sets the driving voltage at the car racetrack to a second predetermined value above the driving voltage maximally supplied by the device for varying the electric driving voltage. The second predetermined value corresponds to a voltage higher than the voltage output of the electric power supply. During manual operation of the additional controller, an energy accumulator supplies, to the car racetrack, power in addition to the power of the electric power supply.

Preferably, the energy accumulator is a capacitor or a battery.

The additional controller is preferably arranged at a housing of the speed controller.

The additional controller, when manually operated, is also preferably constructed to set the driving voltage at the car racetrack to the value of the voltage output of the electric power supply independently of the position of the controller for varying the electric driving voltage.

The controller for varying the electric driving voltage preferably transmits maximally 60% to 90%, particularly 70%, 75% or 80%, of the output voltage of the electric power supply as driving voltage to the car racetrack.

The additional controller is preferably constructed as an electronically or mechanically acting pushbutton or switch.

The controller for varying the electric driving voltage preferably comprises an adjusting push rod for operating a variable resistor, particularly a switching resistor. At least one multiplier resistor is looped into the connection between the electric power supply, the variable resistor and a conductor rail of the car racetrack.

The additional controller is preferably constructed and arranged for electrically bridging the variable resistor and the multiplier resistor.

The additional controller is constructed and arranged for electrically connecting an output of the electric power supply directly with corresponding conductor rails on the car racetrack.

An advantage of the invention is that, during the operation of the game, by operating the device for varying the electric driving voltage, an optimal adaptation to the route will be possible in such a manner that fast driving is avoided in curves, so that the toy vehicle can be driven along the route more easily and with a reduced risk of jumping the track. On the other hand, the additional operating device makes it possible to provide the toy vehicle with a sufficient momentum in special situations, as, for example, before a looping, on a straight line for passing, or in front of a car jump device. The vehicle handling of the toy vehicle with respect to the manually operable speed controller is improved because the voltage range of the driving voltage varied by the operating path of the speed controller can be adapted correspondingly.

In the following, the invention will be explained in detail by means of the drawing.

DETAILED DESCRIPTION OF THE DRAWING

Figure 1:
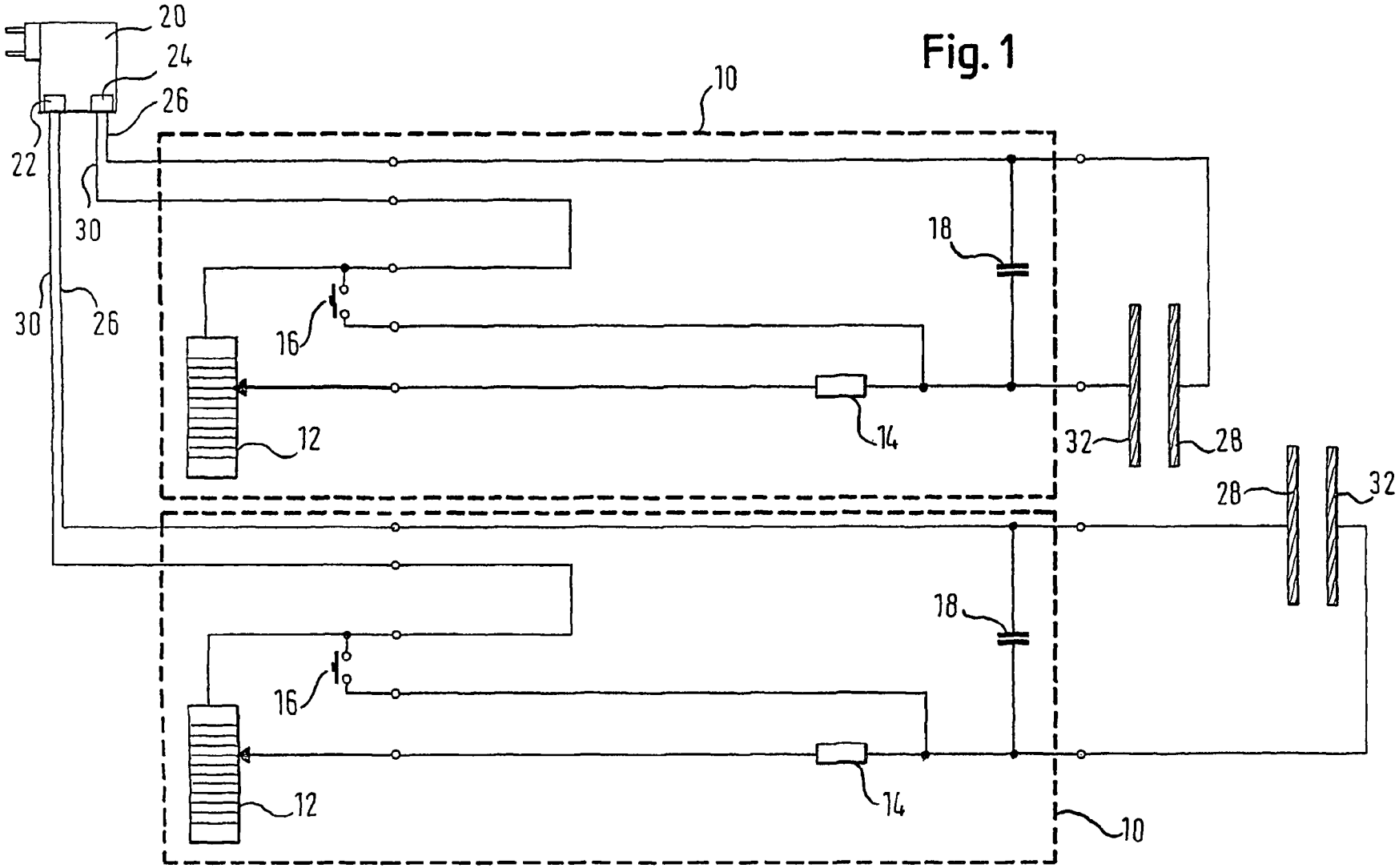
FIG. 1 is a schematic electric circuit diagram of a preferred embodiment of a speed controller according to the invention.

The preferred embodiment of a speed controller 10 according to the invention illustrated in FIG. 1 comprises a variable resistor 12, a multiplier resistor 14 with a fixed resistance value, a switch 16 and a filter capacitor 18. The latter can also be arranged outside the speed controller 10 directly on a car racetrack, which is not shown. An adjusting push rod, which is not shown in FIG. 1 and which changes the resistance value of the variable resistor 12 depending on the position of the adjusting push rod, acts upon the variable resistor 12. For this purpose, the adjusting push rod is disposed to be manually displaceable, for example, by means of a player's thumb, along a predetermined operating path.

For supplying power, a transformer 20 is provided which has two voltage outputs 22, 24. One voltage output 22 and 24 respectively is connected with a speed controller 10. A first pole 26 of the voltage outputs 22, 24 is directly looped through and is connected with a first conductor rail 28 on the car racetrack. A second pole 30 of the voltage outputs 22, 24 is connected with the variable resistor 12. The latter is, in turn, connected by way of the multiplier resistor 14 with a corresponding second conductor rail 32 of the car racetrack. The filter capacitor 18 mutually connects one pair of conductor rails 28, 32 respectively and, as a result, short-circuits high-frequency fractions of the supply voltage. According to the position of the adjusting push rod, the speed controller 10 therefore feeds a variable driving voltage, which is derived from the output voltage of the transformer 20, to the conductor rails 28, 32 of the car race track, which leads to correspondingly different speeds of the toy vehicle moving along this pair of rails 28, 32. However, as a result of the multiplier resistor 14, the maximal driving voltage is limited to a first preset value below the output voltage of the transformer 20. This correspondingly limits the maximal speed of the toy vehicle on the car racetrack.

In addition, the switch 16 is connected such that, when the switch 16 is manually operated, the variable resistor 12 and the multiplier resistor 14 are bridged, so that the complete output voltage of the transformer 20 is applied directly to the conductor rails 28, 32 as the driving voltage. Thus, while the variable resistor 12, even in the case of a maximal deflection, provides only a limited driving voltage below the output voltage of the transformer 20, for example, only 70% or 75% of the output voltage of the transformer 20, the switch 16 provides a type of "boost function" or "turbo function", by which the toy vehicle can be accelerated by means of 100% driving voltage to the maximal speed. In this case, the electrical arrangement is made such that this boost function, when the switch 16 is operated, independently of the position of the adjusting push rod, provides 100% driving voltage or maximal speed for the toy vehicle.

In a further development, which is not shown, additionally, an energy accumulator, such as a capacitor or a battery, is provided, by means of which, when the switch 16 is operated for the boost function, energy can additionally be fed to the transformer. It is thereby possible to, at least for a short time, raise the driving voltage above the output voltage of the transformer 20, so that a correspondingly higher acceleration of the toy vehicle occurs.

FIG. 1 illustrates two speed controllers 10 for a car racetrack with two driving tracks. Here, two players can drive a race against one another. In a concrete embodiment, the transformer 20 has an output voltage of 14.8V and the multiplier resistor has a resistance value of 33 Ohm at 3 W maximal electric power.

Figure 2:
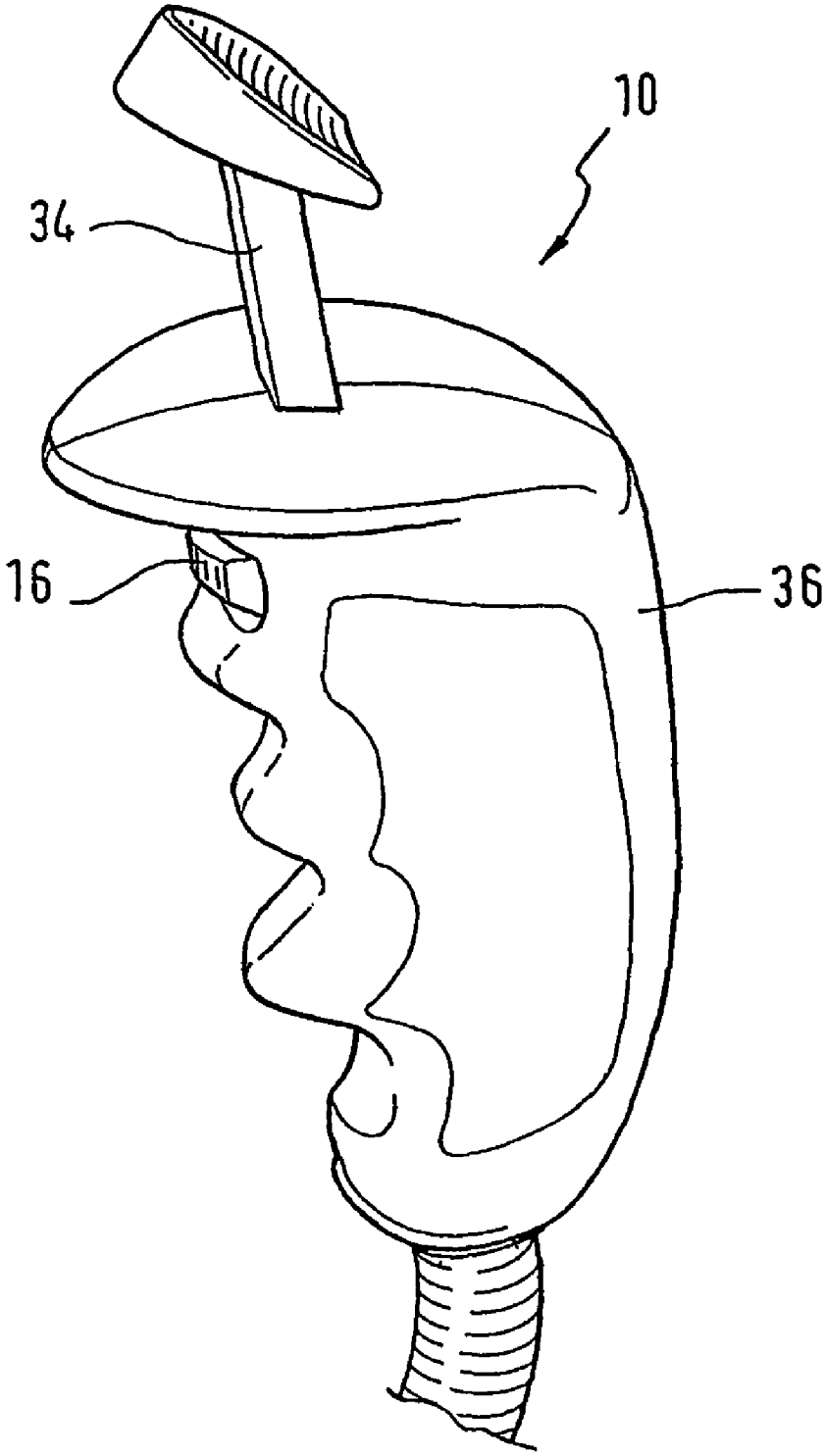
FIG. 2 is a perspective view of a preferred embodiment of a speed controller according to the invention.

FIG. 2 illustrates an example of a structural shape of a speed controller 10 with the adjusting push rod 34 and the switch 16. A housing 36 of the speed controller 10 is constructed so that a user's hand can reach around it. The adjusting push rod 34 can be operated by means of the thumb of the corresponding hand which reaches around. The switch 16 is arranged such on the housing 36 that it can be operated by means of the index finger of the hand reaching around.

The invention claimed is:

1. Speed controller for toy vehicles on electrically conducting tracks of a toy car racetrack, comprising a controller for varying an electric driving voltage from an electric power supply for the tracks of the toy car racetrack, the controller for varying the electric driving voltage including an input manually movable along a predetermined operating path and being constructed for varying the driving voltage supplied by the electric power supply along the operating path from zero to a first predetermined maximal value below the voltage supplied by the electric power supply, an additional controller including an input for manually setting the driving voltage at the tracks of the toy car racetrack to a second predetermined value above the driving voltage maximally supplied by the controller for varying the electric driving voltage, the second predetermined value corresponding to a voltage higher than the voltage output of the electric power supply, and an energy accumulator for supplying, during the manual operation of the additional controller, power to the car racetrack in addition to the power supplied by the electric power supply.

2. Speed controller according to claim 1, wherein the energy accumulator includes a capacitor or a battery.

3. Speed controller according to claim 2 wherein the additional controller, when manually operated, is constructed for setting the driving voltage at the car racetrack to the value of the voltage output of the electric power supply independently of the position of the controller for varying the electric driving voltage.

4. Speed controller according to claim 3 wherein the controller for varying the electric driving voltage is arranged for transmitting maximally 60% to 90% of the output voltage of the electric power supply as driving voltage to the car racetrack.

5. Speed controller according to claim 4 wherein the additional controller is constructed as an electronically or mechanically acting pushbutton or switch.

6. Speed controller according to claim 5 wherein the controller for varying the electric driving voltage comprises an adjusting push rod for operating a variable resistor, at least one multiplier resistor being looped into a connection between the electric power supply, the variable resistor and a conductor rail of the car racetrack.

7. Speed controller according to claim 6, wherein the additional controller is constructed and arranged for electrically bridging the variable resistor and the multiplier resistor.

8. Speed controller according to claim 6, wherein the additional controller is constructed and arranged for electrically connecting an output of the electric power supply directly with corresponding conductor rails on the car racetrack.

9. Speed controller according to claim 1, wherein the additional controller is arranged at a housing of the speed controller.

10. Speed controller according to claim 1 wherein the additional controller, when manually operated, is constructed for setting the driving voltage at the car racetrack to the value of the voltage output of the electric power supply independently of the position of the controller for varying the electric driving voltage.

11. Speed controller according to claim 1 wherein the controller for varying the electric driving voltage is arranged for transmitting maximally 60% to 90% of the output voltage of the electric power supply as driving voltage to the car racetrack.

12. Speed controller of claim 11 wherein the maximum voltage is one of 70%, 80% or 90%.

13. Speed controller according to claim 1 wherein the additional controller is constructed as an electronically or mechanically acting pushbutton or switch.

14. Speed controller according to claim 1 wherein the controller for varying the electric driving voltage comprises an adjusting push rod for operating a variable resistor, at least one multiplier resistor being looped into a connection between the electric power supply, the variable resistor and a conductor rail of the car racetrack.

15. Speed controller according to claim 14, wherein the additional controller is constructed and arranged for electrically bridging the variable resistor and the multiplier resistor.

16. Speed controller according to claim 14, wherein the additional controller is constructed and arranged for electrically connecting an output of the electric power supply directly with corresponding conductor rails on the car racetrack.

17. Speed controller of claim 14 wherein the variable resistor comprises a switching resistor.

18. Speed controller according to claim 1, wherein the energy accumulator includes a capacitor.

19. A speed controller for toy vehicles on first and second electrically conducting toy vehicle tracks, the controller comprising a first control unit having first and second input terminals adapted to be respectively connected to first and second terminals of a voltage source; first and second output terminals respectively adapted to be connected to the first and second tracks; a manually controlled variable resistor having a first terminal electrically coupled with the first input terminal and a second terminal electrically coupled with the first output terminal; the second input terminal being connected to the second output terminal; and a manually activated switch connected between the first input terminal and the first output terminal; the terminals of the controller, the variable resistor and the switch being arranged so that while the first and second terminals of the voltage source are respectively connected to the first and second input terminals and (a) the contacts of the switch are open circuited the voltage applied to the first and second output terminals is equal to the voltage of the source as applied across the first and second input terminals minus a voltage drop due to current flowing from the first input terminal to the first output terminal via the variable resistor, and (b) the switch is closed the variable resistor is by-passed and the voltage at the first output terminal increases to a voltage substantially equal to the voltage applied across the first and second input terminals, a second control unit including an input for manually setting the driving voltage between the first and second output terminals to a value above the voltage between the first and second terminals of the voltage source, the second control unit including an energy accumulator for supplying, during the manual operation of the second control unit, power to the second terminals in addition to the power supplied by the voltage source.

20. The controller of claim 19 wherein the source is an AC source and further including a filter capacitor connected across the first and second output terminals.

21. The controller of claim 19 further including a fixed resistor connected in series with the variable resistor between the first input terminal and the first output terminal.

* * * * *

UNITED STATES PATENT AND TRADEMARK OFFICE

CERTIFICATE OF CORRECTION

PATENT NO. : 7,452,259 B2
APPLICATION NO. : 10/477930
DATED : November 18, 2008
INVENTOR(S) : Hubertus Maleika It is certified that error appears in the above-identified patent and that said Letters Patent is hereby corrected as shown below:

Title page Item [73] should read
Assignee: STADLBAUER SPIEL- UND FREIZEITARTIKEL GmbH Signed and Sealed this Twenty-eighth Day of April, 2009

John Doll

JOHN DOLL
*Acting Director of the United States Patent and Trademark Office*